United States Patent [19]

McGwire

[11] Patent Number: 4,693,479

[45] Date of Patent: Sep. 15, 1987

[54] GOLF CLUB SWING TRAINING DEVICE

[76] Inventor: Robert P. McGwire, 150 W. Drake St., Apt. H4, Pomona, Calif. 91767

[21] Appl. No.: 858,570

[22] Filed: Apr. 24, 1986

Related U.S. Application Data

[63] Continuation-in-part of Ser. No. 678,967, Dec. 6, 1984, abandoned.

[51] Int. Cl.[4] ..... A63B 69/36

[52] U.S. Cl. ..... 273/186 A; 273/186 C; 273/194 R

[58] Field of Search ..... 273/186 R, 186 A, 162 D, 273/193 R, 194 R, 194 A, 194 B; 362/102

[56] References Cited

U.S. PATENT DOCUMENTS

| | | | |
|---|---|---|---|
| 1,128,167 | 2/1915 | Manson | 362/102 X |
| 1,836,034 | 12/1931 | Luchansky | 362/102 |
| 1,908,662 | 5/1933 | Geier | 362/102 |
| 4,456,257 | 6/1984 | Perkins | 273/186 A |

FOREIGN PATENT DOCUMENTS

| | | | |
|---|---|---|---|
| 384590 | 5/1921 | Fed. Rep. of Germany | 362/102 |
| 912515 | 12/1962 | United Kingdom | 273/162 D |
| 1043683 | 9/1966 | United Kingdom | 273/162 D |

*Primary Examiner*—George J. Marlo

*Attorney, Agent, or Firm*—Poms, Smith, Lande & Rose

[57] ABSTRACT

A self-contained detachable device for selective attachment to a golf club to provide a visual indication of the position of the golf club during the swing includes a cylindrical housing which has a light bulb attached to one end to provide a directed beam of light extending outwardly from the housing and a cylindrical mounting cap attached to the other end for removably attaching the housing to the grip end of the club shaft such that the light beam is generated accurately along the same common longitudinal axis as the golf shaft. A first preferred embodiment includes a peg attached to the center of the mounting cap for mating engagement with the opening typically found in the center of the golf club grip end to provide secure and accurate mounting of the housing, as well as a switch provided on the outside of the housing for selectively turning the light bulb on and off. In the second preferred embodiment, the mounting cap further comprises a tightly fitting elastic boot for fitting the end of the club shaft securely to mount the housing and align the light beam, and internalizes the switching mechanism to provide for switching the light on and off by screwing an upper portion of the cylindrical housing in or out. The light beam provides illumination of a well-defined path over the surface surrounding the golf ball during back swing and forward swing.

6 Claims, 7 Drawing Figures

GOLF CLUB SWING TRAINING DEVICE

This is a continuation-in-part of co-pending application Ser. No. 678,967 filed on Dec. 6, 1984, now abandoned.

BACKGROUND OF THE INVENTION

The present invention relates to devices designed to provide visual indicators or cues designed to promote desirable golf swing characteristics. More particularly, the present invention relates to a device which provides the golfer with a visual indication of the position of the golf club during a golf swing by visual reference to the golf ball and the surface surrounding the golf ball.

As is well known, golf clubs are generally of two types: the "wood" or distance clubs, and the "irons". Both types of clubs basically include a shaft having a grip or handle portion on one end with a club head attached to the other end. A complete set of iron golf clubs typically includes nine clubs numbered 1–9. Additionally, the complete "iron" golf club set will include a sand wedge, a pitching wedge, and may include various other specialty clubs. A set of wood clubs will generally include a driver or number one club and shorter distance wood clubs numbered 2–5 or 6.

The head of conventional "iron" clubs is typically made from steel or steel alloys such as stainless steel which may or may not be chrome plated. The head may be cast, forged or machined, to provide a blade portion which is integral with a hosel or neck portion. The blade portion is used in striking the golf ball with the hosel portion being designed to connect the blade to the club shaft. As is well known, the numbered clubs, 1–9, have different shaft lengths and differing blade weights and blade loft angles to allow a golfer to hit a golf ball different distances using approximately the same golf swing.

The ultimate goal of the golf swing, regardless of the type of club being used, is to hit the golf ball in a desired, pre-selected direction or line of flight. In general the golfer positions himself so that his shoulders and feet are substantially parallel to the desired line of flight of the golf ball. A complete golf swing basically includes the backswing, the forward swing, and the follow through. During the golf swing, the golfer must keep his head down and concentrate visually on the location of the golf ball. The requirement that the golfer concentrate on the location of the golf ball necessarily precludes the golfer from visually monitoring the location of the golf club as it is moved through the back swing, the forward swing and follow through. The golfer is indirectly provided with some sense of the location of the golf club during the back swing through the location of the golfer's arms and shoulders and through the feel of the club in the golfer's hands; however, the golfer does not have any direct visual reference as to the exact location of the club during the swing.

In order for the golfer to insure that the golf club travels through the proper plane during the back swing and forward swing, it would be desirable if the golfer could visually monitor the positioning of the club during the swing. This has not been possible in the past since the golfer has been required to keep his eye on the ball (and not on the club) during the golf swing to make sure contact between the club head and ball is made.

It would be desirable to provide some type of device and/or method which would allow the golfer to maintain visual contact with the golf ball during the swing, while at the same time allowing the golfer to visually monitor the position of the golf club during the swing. This would allow the golfer to improve his swing since he can visually monitor the position of the club during the swing and thereby more accurately control the positioning of the club.

SUMMARY OF THE INVENTION

In accordance with the present invention, an apparatus and method are provided which provide a visual indication of the position of the golf club during the back swing and forward swing, wherein the visual indication is provided to the golfer by visual reference to the golf ball and the surface or area immediately surrounding the golf ball. The present invention is based upon a device which is mounted either permanently or removably to the end of the golf club shaft grip or handle. The device includes a light bulb or other light source which is capable of producing a well-defined beam of light. The device further includes means for mounting the light bulb or light source to the golf shaft handle end such that the light beam is directed outward from the shaft handle end and substantially parallel to the golf club shaft. During the golf club swing, the light beam provides illumination of a well-defined path over the surface surrounding the golf ball during the back swing and during the forward swing. Of course, the lighting at the location where the golf club is swung must be sufficiently dim so that the illuminated path provided by the light beam during the golf swing can be seen.

The well defined light beam which is directed outward and substantially parallel to the golf club shaft in accordance with the present invention provides a direct visual indication to the golfer of the location of the golf club during the back swing and foreswing. This allows the golfer to visually check his placement of the club during the swing in order to determine if his swing is proper and/or to alter his swing to achieve a desired illuminated light path during the swing. In addition, the use of a light beam in accordance with the present invention allows the golfer to more accurately reproduce his wing, since he can visually check the light path illuminated by the light beam during the back swing and forward swing and thereby visually control his swing.

The above discussed and many other features and attendant advantages of the present invention will become better understood by reference to the following detailed description when considered in conjunction with the accompanying drawings.

DETAILED DESCRIPTION OF THE INVENTION

Figure 1:
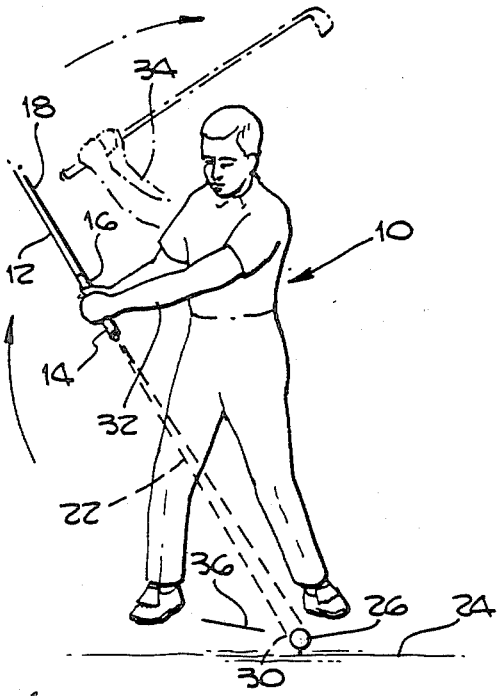
FIG. 1 is a side view of a golfer during the back swing portion of the golf swing utilizing a golf club including a preferred exemplary device in accordance with the present invention.
Figure 2:
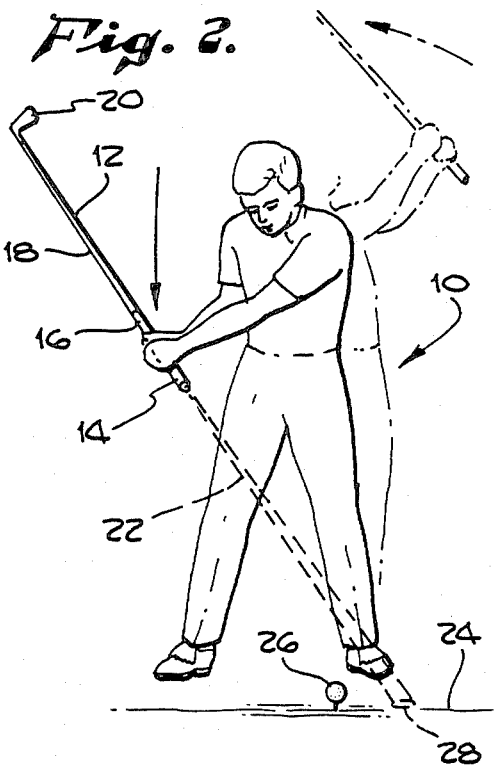
FIG. 2 is the same as FIG. 1 except that it shows the golfer during the forward swing and follow-through portions of the golf swing.

FIGS. 1 and 2 show a golfer 10 during the various portions of a golf swing. FIG. 1 shows the golfer at an intermediate position during the back swing with the position of the golfer at the top of the back swing being shown in phantom. FIG. 2 shows the golfer at an intermediate position during the forward swing with the position during the follow-through portion of the swing being shown in phantom.

The golfer 10 is shown swinging an iron type golf club 12 which includes a preferred exemplary device 14 in accordance with the present invention. The device 14 is attached to the club handle or grip 16. In addition to handle 16, the golf club 12 also includes shaft 18 and club head 20.

As shown in FIGS. 1 and 2, the device 14 in accordance with the present invention is designed to provide a well-defined directed beam of light 22 which is directed outward from the end of the golf shaft handle 16 and substantially parallel to the golf shaft 12. The beam of light is preferably white visible light, such as the light radiated from an incandescent light bulb. However, if desired, any suitable visisble light source may be utilized so long as a well-defined light beam is provided which is of sufficient intensity to allow the golfer to visually see the light beam on the surface 24 surrounding the golf ball 26. The required intensity of light beam 22 may be varied depending upon the location at which the golf club is to be swung. For example, in a dark or very dimly lit room, the intensity of the light beam 22 can be much less than the intensity of the light beam required for utilization of the device outdoors during daylight hours. It is only important that the light beam 22 be of sufficient intensity and be sufficiently well-defined, that the golfer can see an illuminated spot 28 on surface 24 as shown in FIG. 2. Or as shown at 30 in FIG. 1. Preferably, the illuminated spot 28 will have a diameter which is sufficiently large to be easily seen by the golfer, while still being sufficiently well-defined to be clearly visible. The diameter of the spot is preferably close to the diameter of a standard golf ball. Light beams producing slightly larger lighted spots with diameters of up to a few inches are also suitable. In addition, although light sources producing white light are preferred, other light sources which produce a red, green, blue or yellow illuminated spots may also be used if desirable.

When utilizing the device 14 in accordance with the present invention, the golfer during the back swing and forward swing visually observes the path of light beam 22 as it travels rearward and forward across surface 24. In FIG. 1, the light beam 22 is shown at an intermediate position in the back swing where the golf club 12 is positioned so that the light beam 22 illuminates the golf ball. At an earlier point in the back swing, the light beam 22 illuminates a spot on surface 24 located in front of golf ball 26. As the back swing progresses to the position shown at 32 and 34, the light beam 22 travels from in front of golf ball 26, preferably over golf ball 26 and then behind golf ball 26 in the direction represented by arrow 36. The travel of the light beam over surface 24 during the back swing produces a well-defined illuminated path or line which is visible to the golfer. The position of the illuminated line during the back swing provides the golfer with a visual indication of the position of the golf club and more particularly the golf club shaft during the back swing.

During the forward swing, as shown in FIG. 2, the light beam 22 travels from a position behind the ball 26, preferably over ball 26 and through the position shown in FIG. 2 where spot 28 is illuminated. Again, a well-defined illuminated path or line is produced on surface 24 during the forward swing. Optimally, the golfer will attempt to illuminate a forward path or line during the forward swing which is superimposed upon the line previously illuminated over surface 24 during the back swing. This provides a means for the golfer to visually monitor the position of the golf club 12 during the swing and insure that the positioning of the club during the back swing arc is as close as possible to the positioning of the club during the forward swing. Further, the path over which lighted spot travels during the back swing and forward swing allows the golfer to monitor the position of the club during these portions of the swing and determine which club positions provide desired golf ball hits and to reproduce the swing by reference to the illuminated paths provided by beam 22 during subsequent swings.

The device 14 is designed for use during practice in dimly lit rooms where a small flashlight type light beam provides a light beam of sufficient intensity to illuminate a well-defined path on the floor of the room during practice swings. However, if a sufficiently intense and well-defined light beam is utilized, the device 14 can be used on the golf course during daylight hours, if desired.

Figure 3:
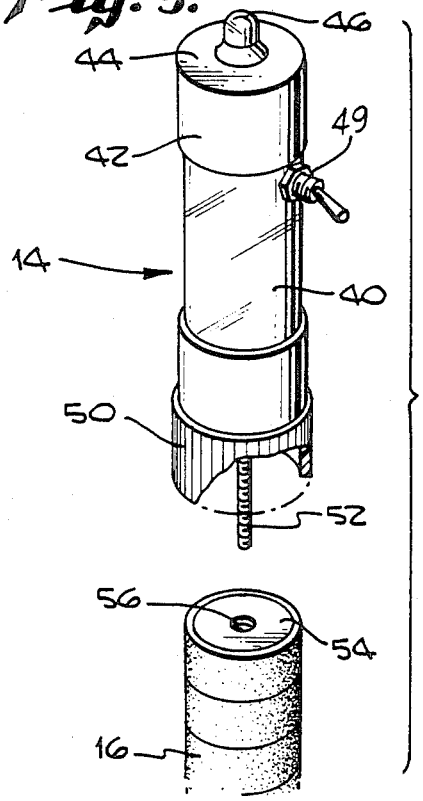
FIG. 3 is a perspective view of a first preferred exemplary device in accordance with the present invention.
Figure 4:
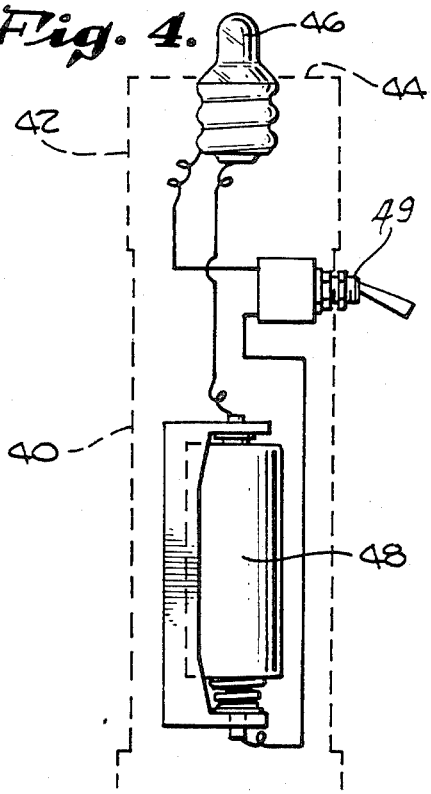
FIG. 4 is a partial schematic representation of a first preferred exemplary light bulb and battery configuration in accordance with the present invention.

A more detailed view of a first preferred embodiment of the device 14 is shown in FIGS. 3 and 4. The device 14 includes a cylindrical housing 40. The cylindrical housing 40 is preferably made from a lightweight, strong material such as polyethylene, polyvinylchloride or any of the other many lightweight and strong plastics. A cap 42 is positioned on the top end of cylinder 40. The cap 42 includes a top surface 44 in which suitable light beam means such as light bulb 46 is mounted. The light bulb 46 is preferably of the type commonly used in small flashlights which provide a well-defined directed beam of light. Any type of light bulb and lens or reflector arrangement can be utilized so long as a sufficiently intense well-defined light beam is provided which can illuminate a well-defined spot on the surface surrounding the golf ball as described above.

As best shown in FIG. 4, the light bulb 46 is preferably mounted by way of threads or other suitable means in cap 44. A battery 48 is housed within housing 40 for supplying the necessary electrical current to bulb 46. Switch 49 is located on the side of the housing 40 to allow the golfer to selectively turn the light bulb 46 on and off. Preferably, the cap 44 is removable to allow easy replacement of the battery 48. The light bulb, battery and switch system shown in FIG. 4 is of course exemplary only with numerous other different light bulb, battery and switch configurations being suitable so long as the system is sufficiently miniaturized to fit in a cylindrical housing of the type 40 for connection to the grip end of a golf club.

As best shown in FIG. 3, means for mounting the cylindrical housing 40 of the first preferred embodiment to the golf club grip is provided by mounting cap 50 and peg 52. The cap 50 is designed to matingly fit over the top end 54 of grip 16 with peg 52 designed to fit within opening 56 to provide further alignment and mounting support. The cap 50 and peg 52 are designed to mount the housing 40 and light bulb 46 so that the light bulb produces a directed beam outward from the shaft handle end 54 which is substantially parallel to the golf club shaft 12.

Although the exemplary embodiment is designed to be attached to the end of the golf club as shown in FIGS. 1 and 2 and also be easily removable, other embodiments are possible in which the device is inserted within the golf club shaft for permanent mounting or removable mounting. However, devices of the type shown in FIG. 3 are preferred, since they can be easily attached to the club grip for use during practice in dimly lit rooms and then conveniently removed prior to actual play on the golf course.

Figure 5:
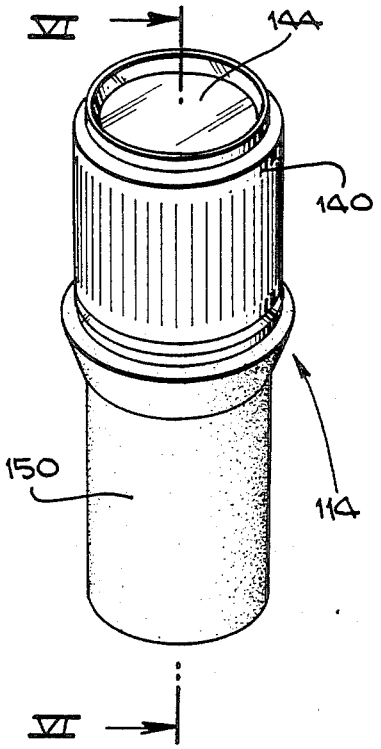
FIG. 5 is a perspective view of a second preferred exemplary device in accordance with the present invention.
Figure 6:
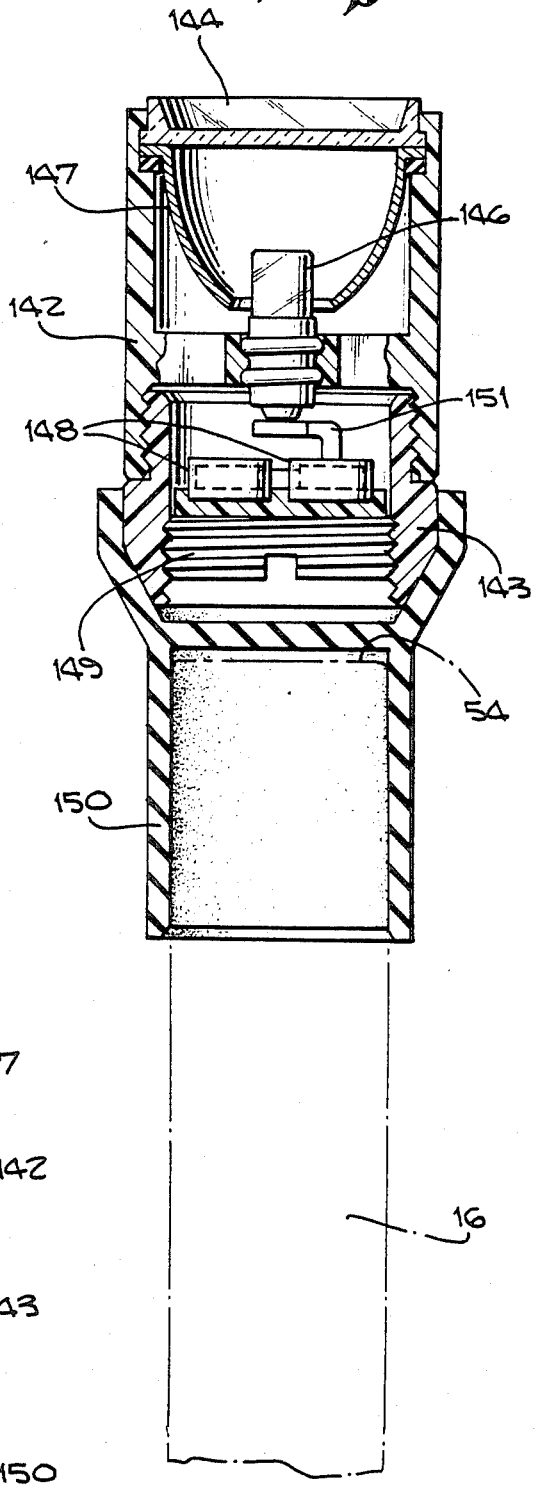
FIG. 6 is a sectional view through the side of the second preferred exemplary embodiment, as revealed by the section VI—VI taken in FIG. 5.
Figure 7:
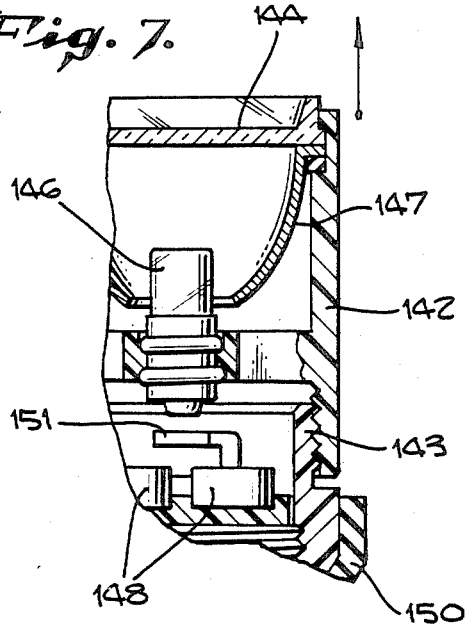
FIG. 7 is a partial sectional view through the second preferred embodiment illustrated in FIG. 6 showing the upper portion of the cylindrical housing screwed upward in the direction of the arrow for turning the device off.

An exemplary second preferred embodiment of such a device which is adapted for ease of attachment and removal is illustrated in FIGS. 5–7, in which similar elements are numbered the same as in the first embodiment, plus 100.

In the second preferred embodiment of the device 114 illustrated, cylindrical housing 140 comprises an upper portion 142 and a lower portion 143 which are threaded internally and externally, respectively, to screw together. The top surface of cylindrical housing 140 mounts a transparent lens 144 through which light bulb 146 mounted internally of upper portion 142 may direct its light beam. Upper portion 142 also supports, behind lens 144, a reflector 147 to focus and direct the light beam of light bulb 146.

Batteries 148 are internalized within lower portion 143 and are inserted and replaced by means of a threaded access plate 149 which screws into the underside of lower portion 143.

The second preferred embodiment of the device 114 is preferably attached and detached to the top end 54 of grip 16 by means of an elastic mounting boot 150, which is made slightly undersized at both its upper end and its lower end to snap over and snugly grip the lower end of lower portion 143 and top end 54 of grip 16 for mounting and supporting housing 140 and light bulb 146 such that light bulb 146 produces a directed beam outward from the shaft handle end 54 which is substantially parallel to the golf club shaft 12.

As may be seen readily from FIGS. 6 and 7, electrical connection and disconnection between light bulb 146 and batteries 148 is through an electrical contact 151 so disposed to the contacting end of bulb 146 and interconnected between batteries 148 that, upon screwing of upper portion 142 of cylindrical housing 140 in the direction of the arrow shown in FIG. 7, bulb 146 is caused to translate away from electrical contact 151 such that the circuit is broken and the device turned off. Upon screwing upper portion 142 in the opposite direction, light bulb 146 is brought into contact with electrical contact 152 and the device is turned on.

Having thus described exemplary embodiments of the present invention, it should be noted by those skilled in the art that the within disclosures are exemplary only and that various other alternatives, adaptations and modifications may be made within the scope of the present invention. Accordingly, the present invention is not limited to the specific embodiments as illustrated herein, but is only limited by the following claims.

What is claimed is:

1. A self-contained detachable device for selective attachment to a golf club to provide a visual indication of the position of the golf club during the backswing, forward swing and follow through portions of a golf swing wherein said visual indication is provided by visual reference to the golf ball being struck and the surface surrounding the golf ball, said golf club including a shaft having a longitudinal axis and a club head, said shaft having a grip portion with an end, said grip portion end having a circumference, said device comprising:

a cylindrical housing having a longitudinal axis, a top end and a bottom end;

means for securely mounting said cylindrical housing to said end of said grip portion of said shaft and for aligning said cylindrical housing coaxially with the longitudinal axis of said shaft;

light bulb means associated with said cylindrical housing top end for providing a directed beam of light extending outward from said housing in a direction along the longitudinal axis of said cylindrical housing and shaft when said housing is mounted thereon, said light bulb means being capable of providing a well-defined spot of light on the surface surrounding said golf ball during said golf swing;

battery means located within said cylindrical housing for providing electric current to said light bulb means; and switch means associated with said cylindrical housing for providing a selective electrical connection between said battery means and said light bulb means to thereby selectively provide said light beam, wherein said light beam provides said visual indication of the position of said golf club during the golf swing by visual reference to the position of said spot of light relative to the golf ball being struck and the surface surrounding the golf ball when said device is mounted to said grip end.

2. The device of claim 1, wherein said means for mounting and for aligning said cylindrical housing to said shaft further comprise:

a cylindrical elastic boot attached to the bottom end of said cylindrical housing, said boot having an upper portion with a center and a cylindrical wall extending upward from said boot for snapping over said bottom end of said cylindrical housing to retain said boot thereon, and a bottom portion with a center and a cylindrical wall extending downward for defining a cavity of sufficient circumference to snap-fit over the circumference of said grip end for mounting said housing to said grip and for aligning said housing longitudinally with the longitudinal axis of said shaft.

3. The device of claim 1 wherein said switch means is located on the outside of said cylindrical housing.

4. The apparatus of claim 1 wherein said switch means further comprises:

said cylindrical housing further including an upper and a lower portion which thread together, said upper portion mounting said light bulb means and said lower portion mounting said battery means in a spaced relationship with one another such that said light bulb means is selectively connected electrically with said battery means when said upper portion of said housing is screwed into said lower portion and is selectively disconnected electrically from said battery means when said upper portion is screwed out of said lower portion, whereby said device is turned on and off, respectively.

5. A golf club having the device according to claim 1 mounted thereon.

6. A device according to claim 1 wherein said light bulb means provide a well-defined light beam of visible light which is red, blue, green or yellow.

* * * * *